US006001006A

United States Patent [19]

Pineau et al.

[11] Patent Number: 6,001,006

[45] Date of Patent: Dec. 14, 1999

[54] MACHINE FOR MACHINING INTERNAL SURFACES OF AXISYMMETRIC WORKPIECES USING AN ABRASIVE STRIP

[75] Inventors: Jean Claude Pineau, Chailly en Biere; Richard Bonachera, Vincennes; Patrick Jeanne, St Thibault, all of France

[73] Assignee: Sociétédes Procédéset Machines Spéciales, Evry Cedex, France

[21] Appl. No.: 08/963,708

[22] Filed: Nov. 4, 1997

[30] Foreign Application Priority Data

Dec. 31, 1996 [FR] France ..... 96 16258

[51] Int. Cl.[6] ..... B24B 21/20

[52] U.S. Cl. ..... 451/297; 451/51; 451/303; 451/307

[58] Field of Search ..... 451/51, 61, 297, 451/303, 304, 307, 311

[56] References Cited

U.S. PATENT DOCUMENTS

| | | | |
|---|---|---|---|
| 759,995 | 5/1904 | Hodd | 451/303 |
| 2,798,340 | 7/1957 | Roberts . | |
| 2,828,586 | 4/1958 | List et al. | 451/304 |
| 3,524,284 | 8/1970 | Means | 451/303 |
| 3,628,291 | 12/1971 | Visconti | 451/51 X |
| 4,187,645 | 2/1980 | Lind | 451/297 |
| 4,601,133 | 7/1986 | Gebald et al. . | |
| 4,603,510 | 8/1986 | Rasmussen | 451/297 |
| 4,796,387 | 1/1989 | Johnson . | |
| 5,042,204 | 8/1991 | Johnson . | |
| 5,148,639 | 9/1992 | Sakai et al. | 451/304 X |
| 5,193,314 | 3/1993 | Wormley et al. | 451/307 X |
| 5,361,546 | 11/1994 | Jonsson | 451/311 X |
| 5,394,653 | 3/1995 | Maier | 451/304 X |
| 5,399,125 | 3/1995 | Dozier | 451/303 X |
| 5,433,042 | 7/1995 | Billieres et al. | 451/307 X |
| 5,735,733 | 4/1998 | Lombardi | 451/51 X |

FOREIGN PATENT DOCUMENTS

| | | |
|---|---|---|
| 0552885 | 7/1993 | European Pat. Off. . |

*Primary Examiner*—Timothy V. Eley
*Attorney, Agent, or Firm*—Smith, Gambrell & Russell, LLP

[57] ABSTRACT

A machine for machining internal surfaces of axisymmetric workpieces with an abrasive strip. The machine includes a roller for pressing the abrasive strip against a surface of the workpiece that is to be machined. The workpiece rotates about an axis, and the roller rotates about an axis parallel to the axis of the workpiece. The machine also includes a pulley positioned on either side of the roller, for guiding the abrasive strip to the roller and holding the abrasive strip in position relative to the roller. The abrasive is driven continuously over the roller during machining, to renew the abrasive where the roller presses the abrasive strip against the surface of the workpiece. The roller and pulleys can be moved oointo, out of, and within a workpiece.

8 Claims, 4 Drawing Sheets

1
1a
2
3
4
5
6
7
8
9
10
11
12
13
14
15
16
17
18

17
16
15
1
10
18
13
11
I
I
13
10
15
16
17
9
7
4
8
9

6
5
4
7
17
9
8
20a
16
20b
15
18
8a
3
14
10
12
13
11
2
20

MACHINE FOR MACHINING INTERNAL SURFACES OF AXISYMMETRIC WORKPIECES USING AN ABRASIVE STRIP

BACKGROUND OF THE INVENTION

The present invention relates to a machine for machining internal surfaces of axisymmetric workpieces using abrasive strip.

BACKGROUND OF THE INVENTION

Document U.S. Pat. No. 4,796,387 discloses a machine for superfinishing the external surfaces of workpieces by machining them with abrasive strip. This machine is formed of a unit comprising a reel that pays out abrasive strip, a reel for rewinding the abrasive strip, with a motor for driving this strip, a head carrying a pressing roller for pressing the abrasive strip against the surface to be machined, means for making said head move back and forth in translation parallel to the axis of the roller, and movement means for making the head move in a translational movement perpendicular to the axis of the pressing roller, with a view to making the pressing roller press the abrasive strip against the surface to be machined. Because of its structure, this known machine can be used only for machining external surfaces of workpieces.

Document EP-A-0,552,885 discloses a machine for the superfinishing of brake drums using abrasive strip, therefore for superfinishing an internal surface of an axisymmetric workpiece. This machine comprises means of accommodating a workpiece and of rotating this workpiece about its axis of revolution, means of pressing an abrasive strip against the internal surface of the workpiece to be machined, means of driving the said strip to make it pass over the said pressing means, and movement means for introducing the pressing means into the workpiece and withdrawing them therefrom, for making the pressing means press the abrasive strip against the surface of the workpiece to be machined, and for making the pressing means move back and forth in translation parallel to the axis of the workpiece while the abrasive strip is being pressed against the surface to be machined. In this known machine, the pressing means consist of a shoe which has a pressing surface of semi-cylindrical shape that more or less corresponds to a portion of the surface to be machined, this shoe being mounted so that it can pivot about an axis perpendicular to the axis of the workpiece, on a support arm which itself can pivot about an axis perpendicular to the axis of the workpiece. Honing stones are incorporated into the semi-cylindrical pressing surface of the shoe, the roughness of which stones is intended to prevent the abrasive strip from slipping relative to the shoe under the effect of the back and forth translational movement given to the shoe during machining. Aside from its complicated structure and the difficulties involved in changing the set-up of this machine to suit the various workpieces that have to be machined, this known machine has the drawback of allowing only a very small amount of material to be removed, because of the large area over which the abrasive strip is pressed against the surface to be machined, and because the abrasive strip is secured to the pressing shoe and is therefore unable to move with respect to it while the surface of the workpiece is being machined. In addition, this known machine allows only internal machining and not external machining of internal surfaces of workpieces. Finally, this machine cannot be used for machining deep-set internal surfaces of axisymmetric workpieces.

SUMMARY OF THE INVENTION

The present invention is aimed at a machine for machining internal surfaces of axisymmetric workpieces using abrasive strip, which machine, while being of a simple structure, can easily have its set up altered to suit different workpieces, allows more efficient machining and in particular allows far more material to be removed than the known machines for machining internal surfaces of axisymmetric workpieces.

The invention is also aimed at a machine for abrasive-strip machining that allows both internal machining and external machining of the internal surfaces of axisymmetric workpieces, even of deep-set surfaces.

The machine in accordance with the invention for machining internal surfaces of axisymmetric workpieces using abrasive strip comprises means of accommodating a workpiece and of rotating this workpiece about its axis of revolution. It further comprises means of pressing an abrasive strip against the surface of the workpiece to be machined. It also comprises means of driving this strip in order to make it pass over the said pressing means. The machine additionally comprises movement means for introducing the said pressing means into the workpiece and withdrawing them therefrom, in order to make the pressing means press the abrasive strip against the surface of the workpiece to be machined, and to make the pressing means move back and forth in translation parallel to the axis of the workpiece while the abrasive strip is being pressed against the surface to be machined. According to the invention, the pressing means comprise a roller mounted so that it can rotate about an axis parallel to the axis of revolution of the workpiece on a support, the said roller having a diameter such that it presses the abrasive strip against the surface to be machined along an area which is essentially restricted to a generatrix of the said surface. Two pulleys for guiding the abrasive strip are mounted, one on either side of the roller, so that they can rotate about axis parallel to the axis of the roller, on the same support as this roller, so that the pulleys are set back from the surface to be machined and so that the cheeks of the pulleys guide the abrasive strip and hold the abrasive strip in position with respect to the roller in spite of the back and forth translational movement of the roller relative to the surface to be machined while the latter is being machined. The means of driving the abrasive strip are operated continuously during machining so as to make the abrasive strip pass continuously over the roller and continuously renew the abrasive at the place where the abrasive strip is pressed by the roller against the surface to be machined.

As a preference, the abrasive strip may be paid out from a supply reel of new abrasive strip and, after it has passed over the pressing roller, be wound back onto a reel for collecting worn abrasive strip. These two reels and the means of driving the abrasive strip may be mounted some distance from the pressing roller and from the pulleys that guide the strip. In such a case, the device comprises, between each of the said reels and each guide pulley, at least one deflector which plays a part at least in the movement of introducing the pressing means into the workpiece and in the movement of withdrawing the pressing means from the workpiece and arranged, relative to the associated guide pulley, in such a way as to make the strip change direction, preferably by 90°.

This deflector may advantageously consist of a simple rod inclined preferably at 45° to the axis of the pressing roller, to deflect the strip, when the latter is pressed against the surface to be machined, from a position perpendicular to the axis of the workpiece, inside the latter, into a position more or less parallel to the axis of the workpiece until it leaves this workpiece.

To simplify the structure of the machine, as far as the motion guidance and motion control are concerned, the movement means that produce the movement of introducing the pressing roller into the workpiece and the movement of withdrawing the roller from the workpiece, are such that the said movements take place parallel to the axis of the workpiece.

Thus the said movements can be simple translational movements, which means that they can be brought about for example with rectilinear guidance, and rectilinear control means, such as rams for example.

Advantageously, the abrasive-strip deflectors, preferably inclined rods, can be mounted on the same support as the pressing roller and the guide pulleys.

BRIEF DESCRIPTION OF THE DRAWINGS

Two illustrative and non-limiting embodiments of a machine in accordance with the invention will be described hereafter in greater detail with reference to the appended diagrammatic drawings; in the drawings.

DETAILED DESCRIPTION OF THE INVENTION

Figure 1:
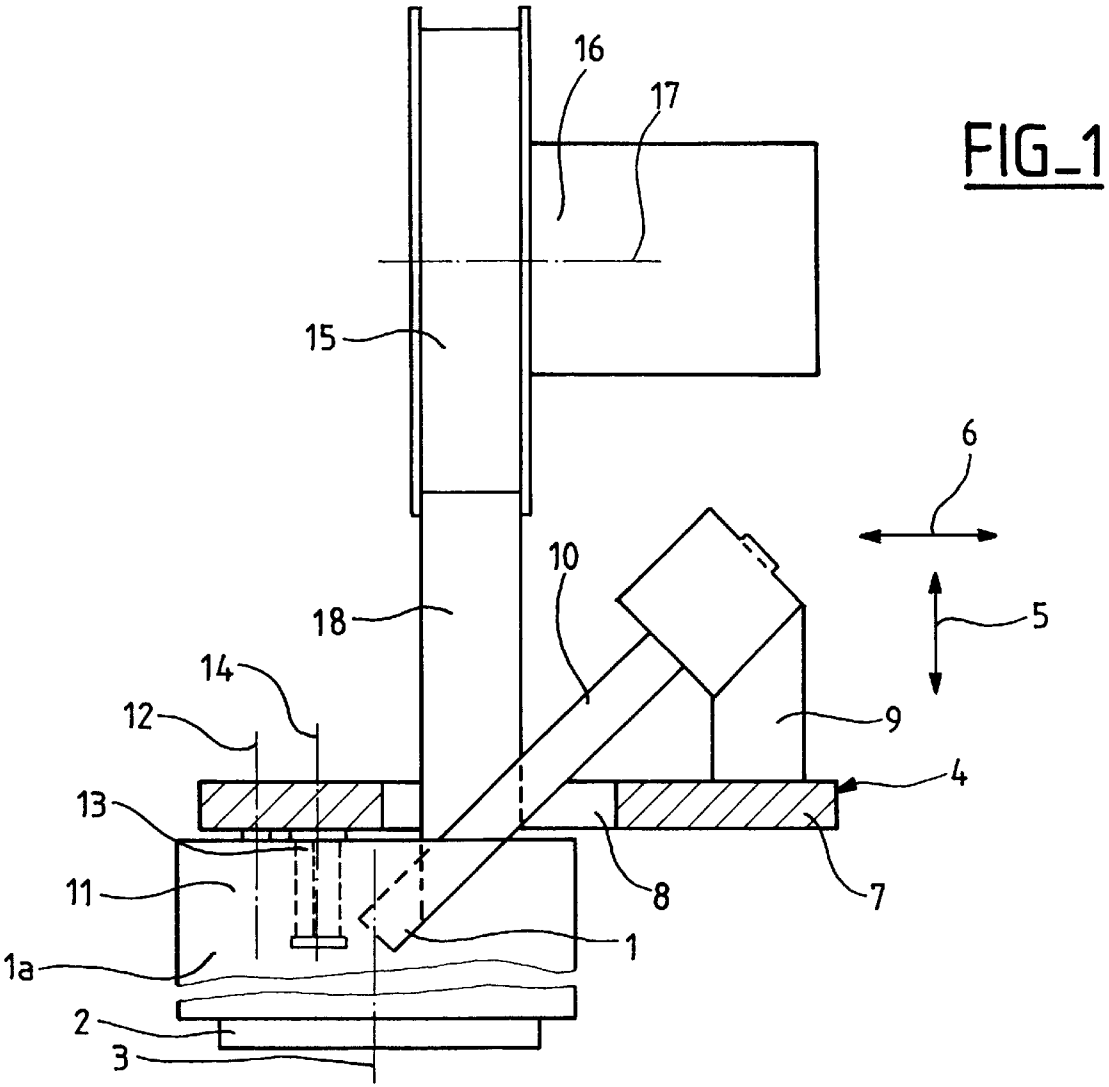
FIG. 1 is a lateral elevation, partially in section on I—I of FIG. 2, of a first embodiment of a machine in accordance with the invention.
Figure 2:
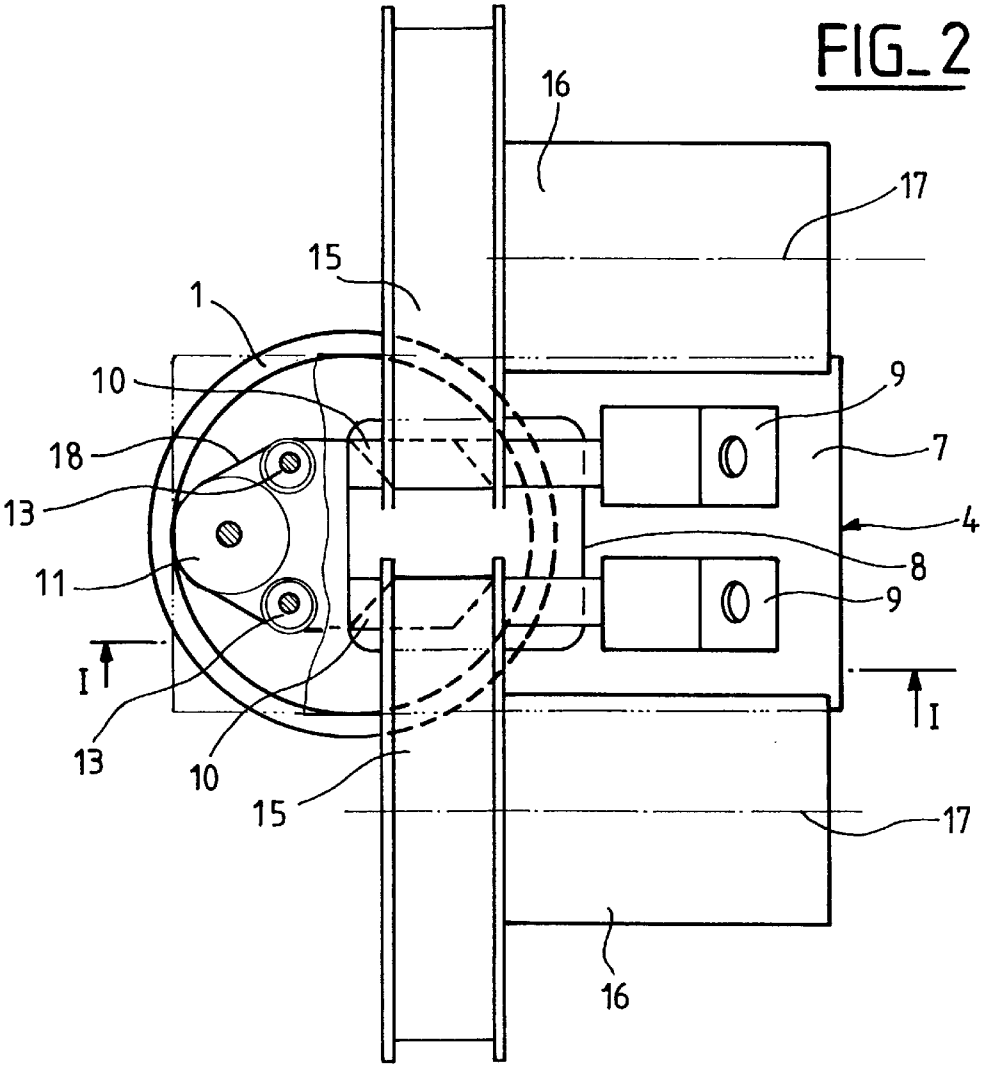
FIG. 2 is a plan view, partially in section, of the machine according to FIG. 1.

According to FIGS. 1 and 2, a machine for machining an internal surface of an axisymmetric workpiece 1 using abrasive strip, that can be used, for example, for superfinishing the bore of a cylinder liner, comprises a part 2 depicted symbolically for accommodating the workpiece 1 and for making it rotate about its axis of revolution 3 which here points vertically.

The machine further comprises a unit 4 which, arranged above the workpiece 1, can move back and forth parallel to the axis 3 of the workpiece 1, therefore vertically (arrow 5), and back and forth at right angles to the axis 3, therefore horizontally (arrow 6). The movements of the unit 4 in these two directions 5, 6 can be produced by linear control means, for example rams, the unit 4 being guided by linear guides, for example slideways, these controls and guides which are symbolized by the arrows 5 and 6, not being depicted.

The unit 4 comprises a rectangular, horizontal, support bed 7, which has a central hole 8 which is square in shape. On one side of the hole 8, the bed 7 carries, by means of two brackets 9 which project upwards, two parallel rods 10 extending downwards at 45° from the brackets 9 through the hole 8 in the support bed 7 so that the free ends of the rods 10 are some distance below the bed 7.

On the other side of the hole 8, the bed 7, on its underside, has a cylindrical roller 11 mounted so that it can rotate about a vertical axis 12. Between the roller 11 and the free end of each of the rods 10, a pulley 13 is mounted so that it can rotate about a vertical axis 14. It can be seen in FIG. 2 that the axis of each of the rods 10 which protrude downwards beyond the bed 7 by a (vertical) height which is at least equal to the breadth of the roller 11 (which corresponds to the breadth of the cylindrical surface of the pulleys 13 between their two cheeks) and the axis 14 of the corresponding pulley 13 are in the same vertical plane. As also shown in FIG. 2, the axes 12 and 14 of the roller 11 and of the pulleys 13 are at the corners of an equilateral triangle, whose vertex furthest from the hole 8 in the support bed 7 is defined by the axis 12 of the roller 11.

Above the support bed 7 are installed two reels 15 of abrasive strip, one acting as a paying-out reel, and the other as a rewind reel. Each of the two reels 15 is mounted on a reel holder 16, and the reel holder that holds the rewind reel can be driven by means, not depicted, while the other holder that holds the paying-out reel may be braked by means, not depicted. The axes 17 of the reels 15 are horizontal and lie in vertical planes parallel to the vertical planes of the axes of the rods 10.

The abrasive strip 18 drawn off one of the reels 15, passes more or less vertically through the hole 8 as far as one of the rods 10, runs around this rod through 180° from the bottom, from the outside towards the inside, to leave it horizontally in the direction of one of the pulleys 13, being deflected by this pulley and guided between its cheeks, and then passes over the roller 11 to return from there to the other reel 15 having passed over the other pulley 13 and the other rod 10.

It should be noted that as is known per se, the abrasive strip 18 has one face which is not coated with abrasive and one face which is coated with abrasive, and that the path taken by the abrasive strip 18 from one reel 15 to the other is chosen to be such that it is that face of the abrasive strip 18 that is not coated with abrasive which comes into contact with the rods 10.

To start off with, with the workpiece 1 held by the accommodation and rotational-drive part 2, the unit 4 is positioned relative to the workpiece 1 so that the roller 11 is above and set back (to the right) from the internal surface (here the internal surface 1*a*) of the workpiece to be machined. By lowering the unit 4 in the direction of the arrow 5 those parts of the unit 4 which lie below the support bed 7 are inserted into the workpiece 1 so that the roller 11 faces the surfaces 1*a* to be machined, a small distance from this surface. Next, with the workpiece 1 rotating about its axis 3 and the rewind reel 15 rotating continuously to make the abrasive strip 18 pass continuously over the roller 11, the abrasive strip 18 is pressed, by the roller 11, with a predetermined force, against the surface 1*a* to be machined, at the same time making the unit 4 move back and forth in vertical translation in the direction of the arrow 5 in order in this way to abrade the surface of the workpiece 1 in a criss-cross pattern as is known per se in the field of super finishing.

Figure 3:
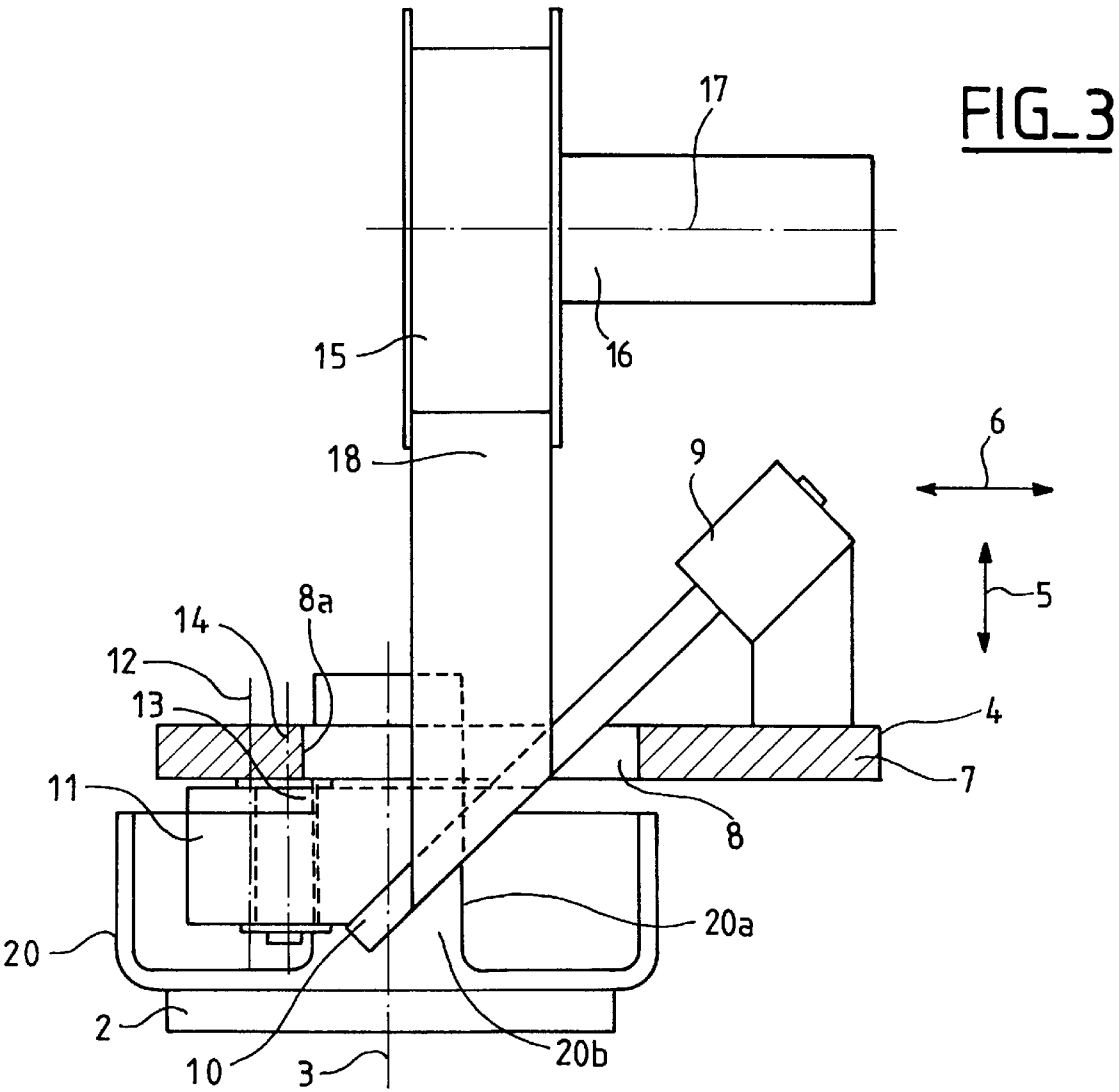
FIG. 3 is a side elevation, partially in section on III—III of FIG. 4, of a second embodiment of the machine in accordance with the invention.
Figure 4:
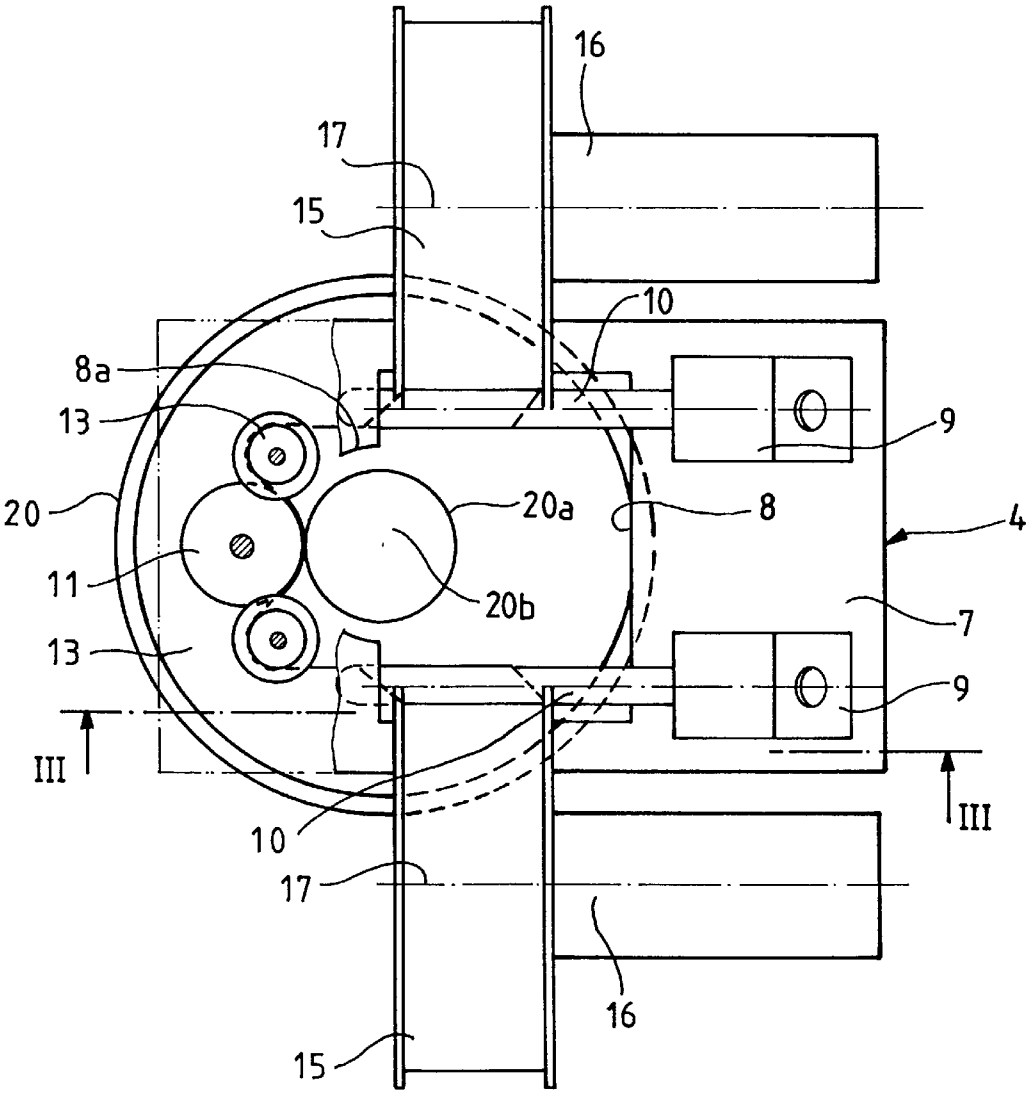
FIG. 4 is a plan view, partially in section, of the machine according to FIG. 3.

FIGS. 3 and 4 illustrate a machine for abrasive-strip machining which differs from the one in FIGS. 1 and 2 in the fact that it is intended for machining the external surface 20*a* of an internal part 20*b* of an axisymmetric workpiece 20. The machine according to FIGS. 3 and 4 has all the same components as the machine of FIGS. 1 and 2, that is to say it still has a part 2 for accommodating and rotating the workpiece about its axis of revolution 3, a unit 4 which can move in two perpendicular directions 5, 6 with two parallel rods 10 inclined at 45° fixed above a bed 7 by two brackets 9, so that they pass through a hole 8 in the bed 7, and a pressing roller 11 and two guide pulleys 13 which are mounted so that they can rotate about parallel axes 12, 14 on the underside of the bed 7. There are also two reels 15, one for paying out and the other for rewinding an abrasive strip 18, these two reels, with horizontal axes 17, lying some distance above the bed 7.

The differences as compared with the embodiment of FIGS. 1 and 2, relate to the shape of the hole 8 in the bed 7, which here has a cut out 8*a* for the passage of the central part

20*b* of the workpiece 20, and especially to the arrangement of the two pulleys 13 relative to the roller 11 and the path taken by the abrasive strip 18 as it passes from one reel 15 to the other; whereas in the embodiment according to FIGS. 1 and 2 the abrasive strip 18 passes over the roller 11 so that its abrasive face faces towards the internal surface 1*a* to be machined of the workpiece 1, in the alternative form according to FIGS. 3 and 4, the abrasive face of the abrasive strip 18 has, as it passes over the roller 11, to be turned to face the external face 20*a* of the central internal part 20*b* of the workpiece 20. For this, the abrasive strip 18 is turned through 180° relative to the embodiment of FIGS. 1 and 2 and passes from the pay out reel from the outside towards the inside over the first deflector rod 10 and vice versa over the other rod 10 before being rewound on the other reel.

The machining cycle for the machine is comparable with the one already described, except that the unit 4, after entering the workpiece 20, is moved in the direction of the arrow 6 to the right so that the abrasive strip 18 is pressed by the roller 11 against the surface 20*a* to be machined.

It should be pointed out that the two embodiments described herein above and illustrated by the appended drawings have been given merely by way of indicative and non-limiting examples and that many modifications and alternative forms are possible within the scope of the invention.

In particular, the various linear movements symbolized by the arrows 5 and 6 are just as applicable to the unit 4 or to the workpiece 1, 20, and therefore the part 2 for accommodating and rotating the workpiece.

The relative arrangement of the deflector rods 10, of the guide pulleys 13 and of the pressing roller 11 may also be chosen differently.

The reels of abrasive strip 18, instead of being arranged some distance above the unit 4 so that they turn about horizontal axes, could also, in particular to reduce the heightwise size of the machine, be arranged for example to the right of the brackets 9, their axes 17 being vertical, in which case, an additional deflector rod could be arranged above each rod 10 parallel to it to return the strip 18 horizontally towards the reels above the workpiece 1, 20.

Depending on the depth of workpiece 1, 20, that is to say depending on the depth at which the surface 1*a*, 20*a* to be machined lies, not only the roller 11 and the pulleys 13, but also the deflector rods 10 could be mounted on a vertical support designed in such a way that the unit 4 thus produced could be engaged completely deep within the workpiece.

We claim:

1. Machine for machining internal surfaces of axisymmetric workpieces using an abrasive strip, comprising:

means for rotating a workpiece about a workpiece axis, means for pressing an abrasive strip against a surfaces of the workpiece, the means for pressing including a roller for pressing the abrasive strip against an area of the surface substantially restricted to a generatrix of the surface, the roller being rotatable about a roller axis parallel to the workpiece axis, and a first pulley positioned on a first side of the roller for guiding the abrasive strip to the roller and holding the abrasive strip in position with respect to the roller, the first pulley being set back from the surface relative to the roller and rotatable about a first pulley axis parallel to the roller axis, and a second pulley positioned on a second side of the roller opposite the first side for guiding the abrasive strip to the roller and holding the abrasive strip in position with respect to the roller, the second pulley being set back from the surface relative to the roller and rotatable about a second pulley axis parallel to the roller axis, means for continuously driving the abrasive strip over the means for pressing during a machining operation, and means for moving the means for pressing into and out of the workpiece, for moving the means for pressing toward and away from the surface, so that the means for pressing can press the abrasive strip against the surface, and for moving the means for pressing back and forth parallel to the workpiece axis while the means for pressing presses the abrasive strip against the surface.

2. Machine according to claim 1, further including:

a supply reel for supplying the abrasive strip to the means for pressing, a collecting reel for collecting the abrasive strip from the means for pressing, at least one supply deflector positioned between the supply reel and the first pulley and being movable with the means for pressing, the at least one supply deflector being arranged relative to the first pulley so as to change a direction of the abrasive strip by 90°, and at least one collecting deflector positioned between the collecting reel and the second pulley and being movable with the means for pressing, the at least one collecting deflector being arranged relative to the second pulley so as to change a direction of the abrasive strip by 90°.

3. Machine according to claim 2, wherein the at least one supply deflector is a rod inclined at 45° to the roller axis, so as to change a direction of the abrasive strip from a direction parallel to the workpiece axis to a direction perpendicular to the workpiece axis.

4. Machine according to claim 3, wherein the means for pressing, the roller the first and second pulleys, the at least one supply deflector and the at least one collecting deflector are all mounted on a same support.

5. Machine according to claim 4, wherein the support is movable parallel to the workpiece axis.

6. Machine according to claim 2, wherein the at least one collecting deflector is a rod inclined at 45° to the roller axis, so as to change the direction of the abrasive strip from a direction parallel to the workpiece axis to a direction perpendicular to the workpiece axis.

7. Machine according to claim 6, wherein the at least one supply deflector is a rod inclined at 45° to the roller axis, so as to change the direction of the abrasive strip from a direction parallel to the workpiece axis to a direction perpendicular to the workpiece axis.

8. Machine according to claim 1, wherein the means for moving moves the means for pressing into and out of the workpiece in a direction parallel to the workpiece axis.

* * * * *